US006861991B2

(12) United States Patent
Mueller et al.

(10) Patent No.: US 6,861,991 B2
(45) Date of Patent: Mar. 1, 2005

(54) INDEPENDENTLY MOUNTED ON-GLASS ANTENNA MODULE

(75) Inventors: Thomas R. Mueller, Swartz Creek, MI (US); Randall J. Robson, Lapeer, MI (US); Martin T. Duane, Rochester Hills, MI (US); William R. Livengood, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 56 days.

(21) Appl. No.: 10/299,928

(22) Filed: Nov. 19, 2002

(65) Prior Publication Data

US 2004/0095284 A1 May 20, 2004

(51) Int. Cl.[7] ..... H01Q 1/32
(52) U.S. Cl. ..... 343/713; 343/711; 343/700 MS
(58) Field of Search ..... 343/713, 711, 343/700 MS, 872, 712, 718, 850, 864, 860, 904, 906

(56) References Cited

U.S. PATENT DOCUMENTS

| | | | | |
|---|---|---|---|---|
| 5,099,250 A | | 3/1992 | Paulus et al. | 343/704 |
| 5,610,619 A | | 3/1997 | Zafar | 343/713 |
| 5,790,079 A | | 8/1998 | Zafar | 343/713 |
| 6,087,996 A | * | 7/2000 | Dery | 343/713 |
| 6,118,410 A | | 9/2000 | Nagy | 343/713 |
| 6,147,654 A | | 11/2000 | Nagy | 343/713 |
| 6,163,303 A | | 12/2000 | Nagy | 343/713 |
| 6,191,746 B1 | | 2/2001 | Nagy | 343/713 |
| 6,211,831 B1 | | 4/2001 | Nagy et al. | 343/713 |
| 6,266,023 B1 | | 7/2001 | Nagy et al. | 343/713 |
| 6,307,515 B1 | * | 10/2001 | Sauer et al. | 343/713 |
| 6,307,516 B1 | | 10/2001 | Zafar et al. | 343/713 |
| 6,317,090 B1 | | 11/2001 | Nagy et al. | 343/713 |
| 6,320,558 B1 | * | 11/2001 | Walton | 343/906 |
| 6,483,468 B2 | * | 11/2002 | Walton | 343/713 |
| 2002/0053735 A1 | * | 5/2002 | Neuhaus et al. | 257/728 |

* cited by examiner

*Primary Examiner*—Don Wong
*Assistant Examiner*—Chuc Tran
(74) *Attorney, Agent, or Firm*—Stefan V. Chmielewski

(57) ABSTRACT

An antenna module provides signals received by an antenna to a communication system, such as a vehicle radio, wireless telephony system, or keyless entry system. The antenna module includes antenna circuitry having a terminal. When a compressible contact is compressed, it electrically couples this terminal to another terminal, which is disposed on a surface. A cover disposed over the antenna circuitry compresses the compressible contact when the cover is adhesively mounted to the surface. As a result, the terminals need not be soldered to the glass or other surface. Accordingly, the manufacturing process can be simplified. For example, the antenna module can be installed independently of other manufacturing processes.

16 Claims, 8 Drawing Sheets

INDEPENDENTLY MOUNTED ON-GLASS ANTENNA MODULE

TECHNICAL BACKGROUND

The present invention relates generally to antenna systems. More particularly, the present invention relates to antenna systems that employ on-glass or hidden antennas.

BACKGROUND OF THE INVENTION

Many vehicles incorporate communication systems that enable them to receive and transmit signals for various purposes. For example, most automobiles are equipped with an AM/FM radio. In addition, many automobiles are further equipped with keyless entry systems, wireless telephony systems, GPS systems, television systems, remote tire pressure monitoring equipment, or other equipment. Antennas typically collect the radio or other waves that are used by such communication systems.

Some conventional vehicle antennas, known as mast antennas, are mounted to the body of the vehicle. Mast antennas may exhibit limited signal performance. Moreover, mast antennas add wind noise and drag to the vehicle, adversely affecting the aerodynamic characteristics of the vehicle, and are susceptible to damage and corrosion.

Another type of conventional vehicle antenna is mounted on a glass surface of the vehicle, e.g., on the windshield or a window. For example, a backlite antenna system includes antenna elements that are embedded in a rear window of the vehicle. These antenna elements can be integral with or separate from other components, such as defogger elements. Examples of backlite antenna systems are disclosed in U.S. Pat. Nos. 5,610,619; 5,790,079; and 5,099,250. Backlite antennas provide a number of advantages relative to mast antennas. Unlike mast antennas, backlite antennas do not protrude from the body of the vehicle and are thus less susceptible to damage and corrosion. Further, backlite antennas add neither wind noise nor drag to the vehicle.

Solar-ray antennas and other film antennas, like backlite antennas, are also located on a glass surface of the vehicle, typically the windshield. While backlite antennas often incorporate antenna elements into the rear window defogger elements, film antennas instead use one or more transparent film elements that are affixed to the windshield. For example, one type of film antenna includes a principal element that is parallel to the top of the windshield and an impedance matching element perpendicular to the principal element.

In many antenna systems, the antenna is coupled to the communication system via an antenna module, which may include, for example, an antenna amplifier, an antenna filter, and other components. For some types of communication systems, such as a remote tire pressure monitoring system or a keyless entry system, the antenna module may also include components for processing the received signal, such as a microprocessor and a receiver. Various leads are electrically connected to the antenna module. For example, the antenna module receives power through a power cable and receives an input from the antenna from another lead. A coaxial cable provides the output from the antenna module to the communication system. In addition, some antenna modules are grounded via a separate lead.

The antenna module may be mounted to the vehicle chassis using a bolt, clip, or nut. This type of mounting is generally performed using an in-plant installation process that involves additional manufacturing processes. A supplier may instead install the antenna module on a headliner of the vehicle, avoiding the need for an in-plant installation process. This installation method, however, still involves fastening a bolt or nut to the vehicle chassis at the vehicle assembly plant. In addition, the glass supplier solders or otherwise installs terminals on the glass to provide connection points to the antenna module.

Alternatively, the antenna module may be mounted on a window or other glass surface of the vehicle. In many on-glass antenna systems and hidden antenna systems, the power and coaxial cables are attached to the antenna module using mechanical press-together connections on loose leads. Some other on-glass antenna systems use compressible silicone contacts into which the leads are inserted. Both types of antenna systems incorporate connectors that are plugged into the antenna module. Installation of on-glass antenna modules has generally involved additional in-plant manufacturing processes, as with chassis-mounted antenna modules.

The in-plant processes involved in installing antenna modules that use plug-in connections require a degree of skill and strength to positively seat the connectors and establish electrical connections. In addition, the coaxial cable is typically inserted into the antenna module before the antenna module is installed in the vehicle. Mishandling of the coaxial cable, such as using the cable as a handle, can compromise electrical connections within the cable, as well as between the cable and the antenna module.

SUMMARY OF THE INVENTION

According to an example embodiment of the present invention, an antenna module includes antenna circuitry having a terminal. When a compressible contact is compressed, it electrically couples this terminal to another terminal, which is disposed on a surface. A cover disposed over the antenna circuitry compresses the compressible contact when the cover is adhesively mounted to the surface.

In another embodiment, a vehicle antenna system includes an antenna having an antenna terminal disposed on a surface of the vehicle and antenna circuitry having an antenna circuit terminal. When a compressible contact is compressed, it electrically couples the antenna circuit terminal to the antenna terminal or another terminal. A cover disposed over the antenna circuitry compresses the compressible contact when the cover is adhesively mounted to the surface.

In still another embodiment, a vehicle communication system includes an antenna having an antenna terminal disposed on a surface of the vehicle and antenna circuitry having an antenna circuit terminal. A communication subsystem has a communication subsystem terminal also disposed on the surface. When a compressible contact is compressed, it electrically couples the antenna circuit terminal to the antenna terminal or the communication subsystem terminal. A cover disposed over the antenna circuitry compresses the compressible contact when the cover is adhesively mounted to the surface.

Another aspect of the present invention is directed to a method for installing an antenna module. Antenna circuitry having a first terminal and a second terminal is provided. A first compressible contact is arranged to electrically couple the first terminal to an antenna terminal disposed on a surface when the compressible contact is compressed. A second compressible contact is arranged to electrically couple the second terminal to a terminal of the communication subsystem also disposed on the surface. A cover disposed over the antenna circuitry is adhesively mounted to the surface. As a result, the compressible contacts are compressed, and the first and second terminals are electrically coupled to the antenna and the communication subsystem, respectively.

Various embodiments of the present invention may provide a number of advantages, particularly improvements in the manufacturing process. For example, the compressible contact generates a spring force when compressed by the cover. This spring force holds the compressible contact in mechanical and electrical contact with the terminals of the antenna circuitry and of the antenna or communication system. As a result, the terminals need not be soldered to the glass or other surface. Accordingly, the manufacturing process can be simplified. For example, a single operation can both mount the antenna module on the glass and establish the required electrical connections. Moreover, the antenna module can be installed independently of other manufacturing processes and free of attachment structures such as cables, pigtails, nuts, bolts, clips, and the like. Material costs and, in turn, installation costs, may be reduced as a result. In addition, with the need for a plug-in connector eliminated, the reliability of the electrical connection to the antenna module can be improved. Initial quality of the antenna module can be likewise improved as a result.

Additional objects, advantages, and features of the present invention will become apparent from the following description and the claims that follow, considered in conjunction with the accompanying drawings.

BRIEF DESCRIPTION OF THE DRAWINGS

The present invention will now be described, by way of example, with reference to the accompanying drawings, in which.

DESCRIPTION OF PREFERRED EMBODIMENTS

The following discussion of various embodiments directed to a vehicle communication system is to be construed by way of illustration rather than limitation. This discussion is not intended to limit the invention or its applications or uses. For example, while various embodiments of the invention are described as being mounted on a window glass of a vehicle, it will be appreciated that the principles of the invention are applicable to antenna modules mounted on other surfaces of a vehicle. Further, the invention may be practiced in connection with communication systems not incorporated in a vehicle.

In one implementation, an antenna module includes antenna circuitry having a terminal. When a compressible contact is compressed, it electrically couples this terminal to another terminal, which is disposed on a surface. A cover disposed over the antenna circuitry compresses the compressible contact when the cover is adhesively mounted to the surface. The antenna module may be implemented as part of a vehicle antenna system or a vehicle communication system.

The present invention may provide a number of advantages, such as improvements in the manufacturing process. For example, because the electrical connection is established and maintained by the spring force generated when the cover compresses the compressible contact, the terminals need not be soldered to the glass or other surface. Accordingly, the manufacturing process can be simplified. For example, a single operation can both mount the antenna module on the glass and establish the required electrical connections. Moreover, the antenna module can be installed independently of other manufacturing processes and free of attachment structures such as cables, pigtails, nuts, bolts, clips, and the like. Material costs and, in turn, installation costs, may be reduced as a result. In addition, with the need for a plug-in connector eliminated, the reliability of the electrical connection to the antenna module can be improved. Initial quality of the antenna module can be likewise improved as a result.

Figure 1:
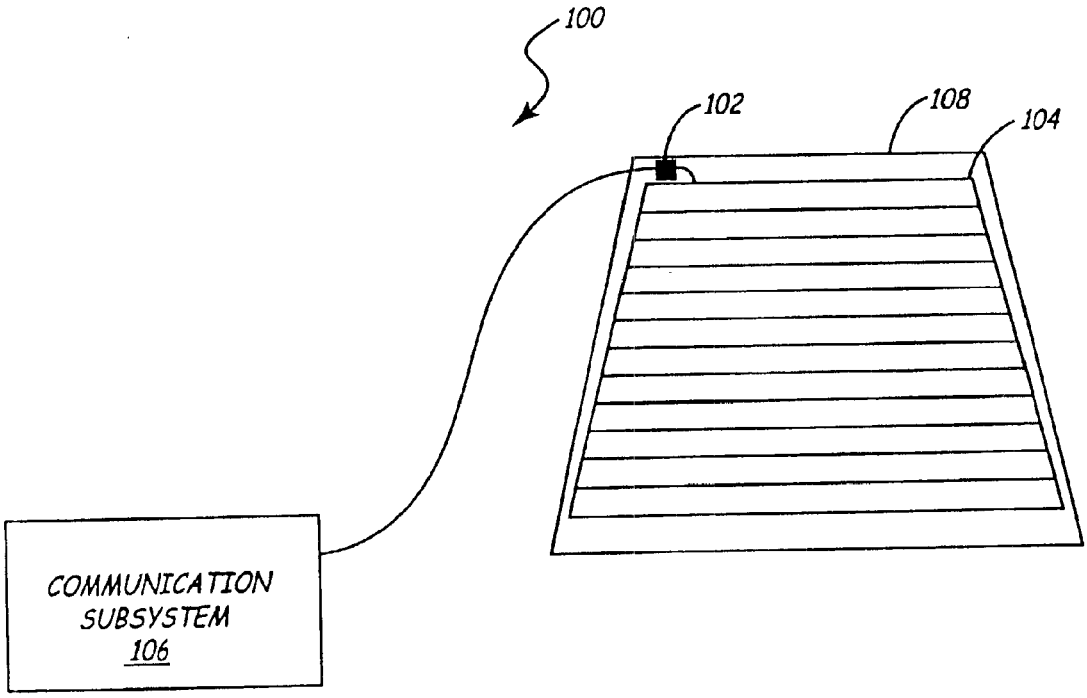
FIG. 1 illustrates an example antenna system incorporating an antenna module according to an embodiment of the present invention.

Referring now to the drawings, FIG. 1 illustrates an example communication system 100 incorporating an antenna module 102 according to an embodiment of the present invention. The antenna module 102 is coupled to an antenna 104 and a communication subsystem 106. The antenna 104 is depicted as a backlite antenna mounted on a window glass 108. It will be understood that the antenna 104 may be implemented as any of a variety of antennas, including, for example, a solar-ray antenna or other transparent film antenna. Further, the antenna 104 may be implemented as an antenna for receiving any of a variety of types of signals, including but not limited to AM radio signals, FM radio signals, television signals, remote tire pressure monitoring signals, and keyless entry signals. Communication subsystem 106 can be implemented as any of a variety of devices that receive or transmit signals, including but not limited to a car radio system, a cellular telephony system, a GPS system, a keyless entry system, a television system, and remote tire pressure monitoring equipment.

In an embodiment of the invention, the antenna module 102 is adhesively mounted on the window glass 108. While not required, the antenna module 102 may incorporate locating features that interact with corresponding locating features on the vehicle to facilitate installation on the window glass 108.

The antenna module 102 is coupled to the antenna 104 via a lead or terminal, such as an antenna grid input terminal. The antenna grid input terminal carries a signal received by the antenna 104, e.g., an AM or FM radio signal. In some implementations, the antenna module 102 may be coupled to multiple antennas 104 via multiple antenna grid input terminals. For example, the antenna module 102 may be coupled to an AM antenna via an AM antenna input terminal and to an FM antenna via an FM antenna input terminal.

The antenna module 102 is also coupled to the communication subsystem 106 via a lead or terminal. More typically, the antenna module 102 is coupled to the communication subsystem 106 via multiple leads or terminals. These leads may include, for example, a coaxial cable having an antenna output terminal and a coaxial shield terminal. In addition, the antenna module 102 may be grounded via an antenna module ground terminal. The antenna module 102 may also receive power via an antenna module power terminal.

According to an embodiment of the present invention, the antenna module 102 includes antenna circuitry having terminals that correspond to the terminals of the antenna 104 and of the communication subsystem 106. The antenna circuitry may also have terminals independent of the antenna 104 and the communication subsystem 106, such as an antenna module ground terminal or an antenna module power terminal.

A compressible contact is arranged between the corresponding terminals. The antenna module 102 includes a cover that, when adhesively mounted to the window glass 108, places the compressible contact under compression, causing a spring force to be exerted by the compressible contact. The spring force holds the compressible contact in mechanical and electrical contact with both of the corresponding terminals. Because the electrical connection is established and maintained by the spring force, the terminals need not be soldered to the window glass 108. Accordingly, mounting and electrical connections can both be established during a single operation. Material costs and, in turn, installation costs, may be reduced as a result. In addition, the reliability of the electrical connection to the antenna module can be improved, resulting in an improvement in the initial quality of the antenna module.

Figure 2:
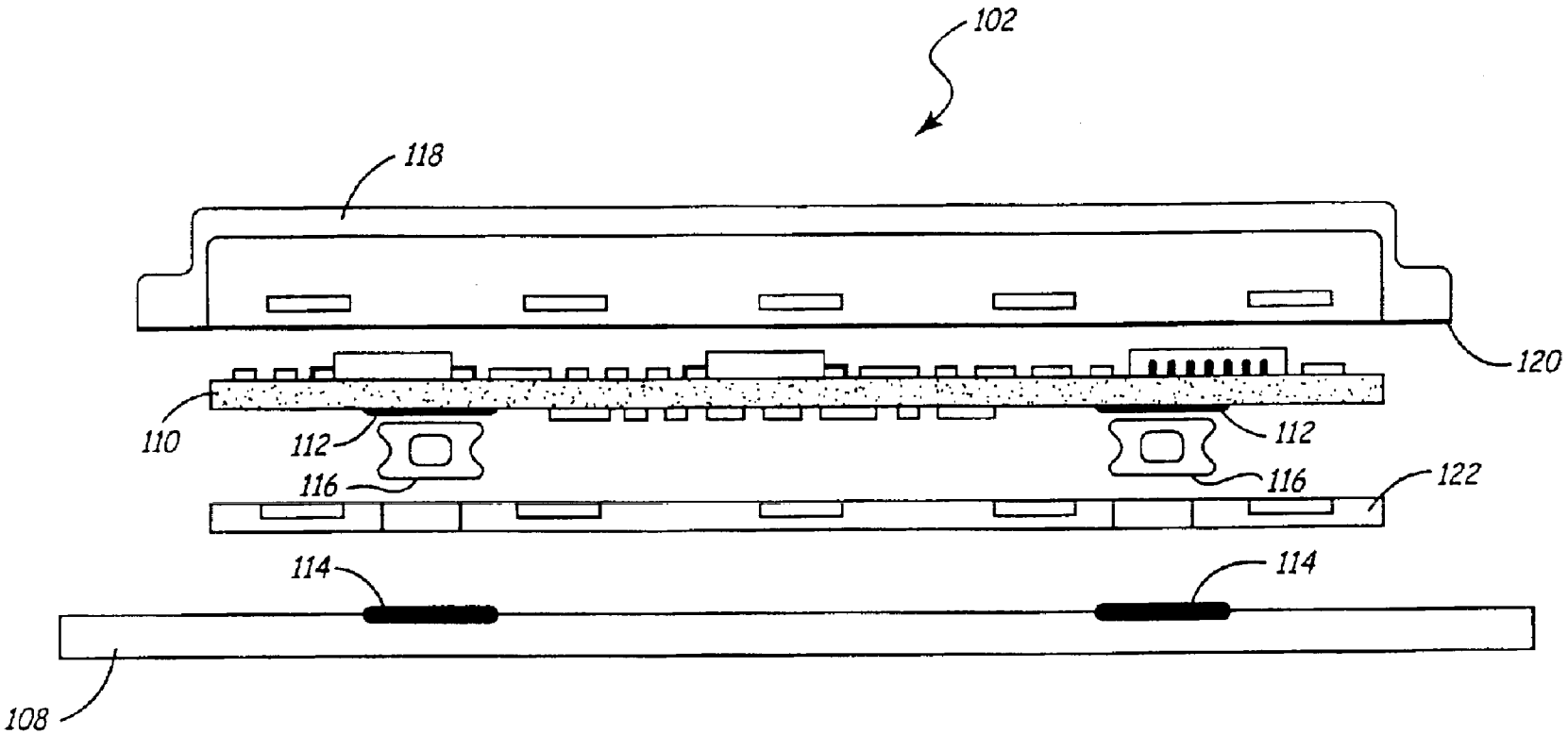
FIG. 2 is an exploded sectional view of an example antenna module according to another embodiment of the present invention.
Figure 3:
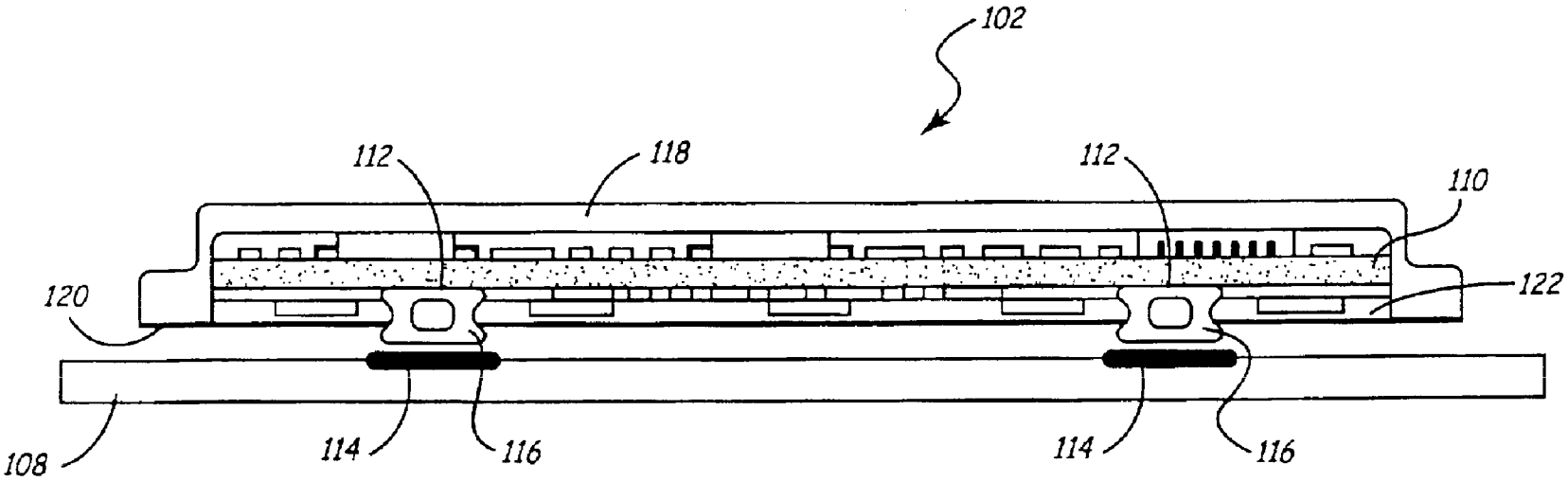
FIG. 3 is a sectional view of the antenna module of FIG. 2.

FIG. 2 is an exploded sectional view of an example implementation of the antenna module 102. FIG. 3 is a sectional view illustrating the antenna module 102 as assembled. The antenna module 102 includes antenna circuitry formed on an antenna circuit board 110. The antenna circuit board 110 may include, for example, filters, amplifiers, and other circuitry for processing a signal received by the antenna 104. For certain types of communication subsystems, such as a remote tire pressure monitoring system or a keyless entry system, the antenna circuit board 110 may include components for decoding or otherwise processing a received signal, such as a receiver and a microprocessor. The antenna circuitry includes first and second antenna circuit terminals 112 and 112', such as antenna input terminal and one of an antenna module output terminal, a coaxial shield terminal, and antenna module ground and power terminals. In addition, the antenna circuit terminals 112, 112' may include terminals connecting the antenna module 102 to a vehicle communication bus. The antenna circuit terminals 112, 112' correspond on a one-to-one basis with terminals 114, 114' disposed on the window glass 108.

A first compressible contact 116 is disposed between antenna circuit terminal 112 and corresponding terminal 114. A second compressible contact 116' is disposed between the second terminal 112' and the corresponding terminal 114'. The compressible contacts are formed of a compressible and electrically conductive material. For example, while not required, the compressible contacts 116, 116' may be formed of silicone impregnated with an electrically conductive material.

Figure 7:
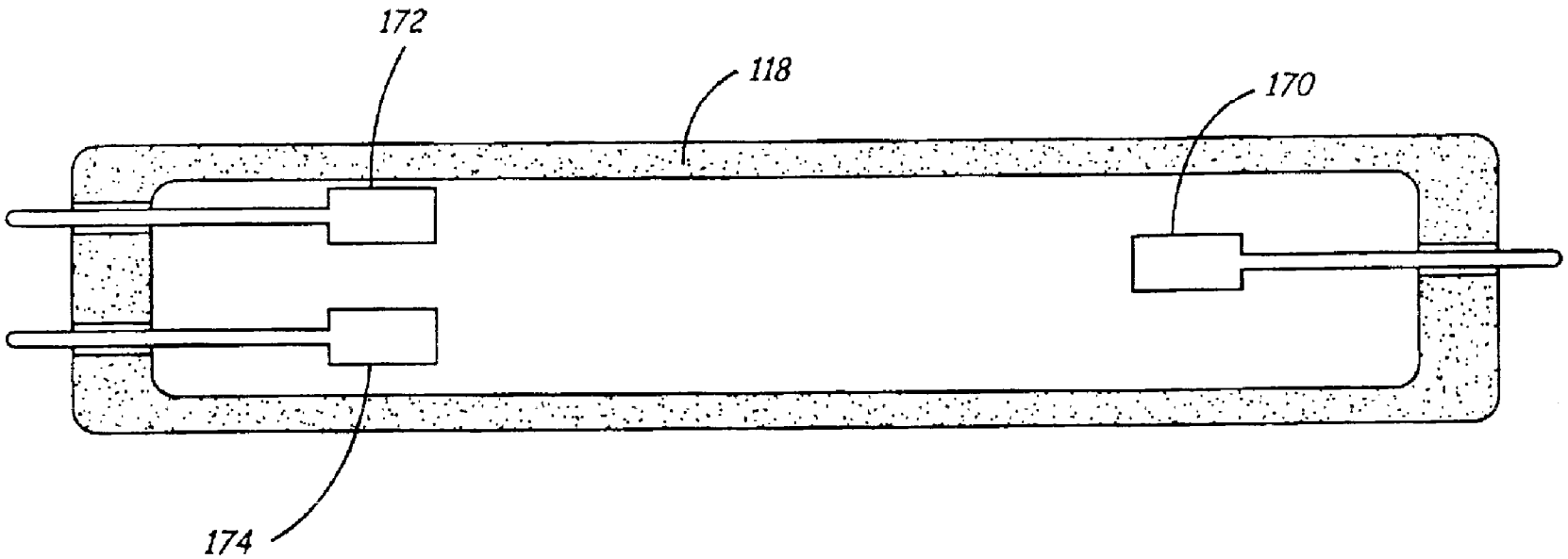
FIG. 7 is a bottom view of yet another example configuration of the antenna module of FIG. 2.

A cover 118 is installed over the antenna circuit board 110. In some implementations, the cover 118 is formed of an electrically nonconductive material, such as plastic or foam. Other implementations may feature a cover 118 formed of an electrically conductive material, as shown in FIG. 7.

To install the antenna module 102, the cover 118 is placed over the antenna circuit board 110 and is adhesively mounted to the window glass 108. Adhesive mounting may be accomplished, for example, by removing a pre-installed peel-away film to expose an adhesive on a surface 120 of the cover 118. The adhesive is preferably implemented as an electrically nonconductive high-temperature adhesive. Adhesively mounting the cover 118 on the window glass 108 compresses the compressible contacts 116 and 116', thereby generating a spring force that holds the compressible contact 116 in mechanical and electrical contact with the terminals 112 and 114, and compressible contact 116' in mechanical and electrical contact with terminals 112' and 114'. As a result, the terminals 112 and 112' need not be soldered to the window glass 108. Mounting and electrical connections can both be established during a single operation, reducing material and installation costs while providing a reliable electrical connection.

In some embodiments, the antenna module 102 may also include an antenna base 122 that snaps together with the cover 118. The antenna module base 122 may have locating features, such as apertures, to facilitate placement of the compressible contacts 116 and 116'.

The configuration of terminals 112 and 112' on the antenna circuit board 110 and 114 and 114' on window glass 108 may vary according to the particular antenna configuration and antenna module configuration. FIGS. 4–7 are bottom views illustrating several example configurations of the antenna module 102. These configurations are provided by way of example only, and should not be construed as an exhaustive enumeration of all possible configurations of the antenna module 102.

Figure 4:
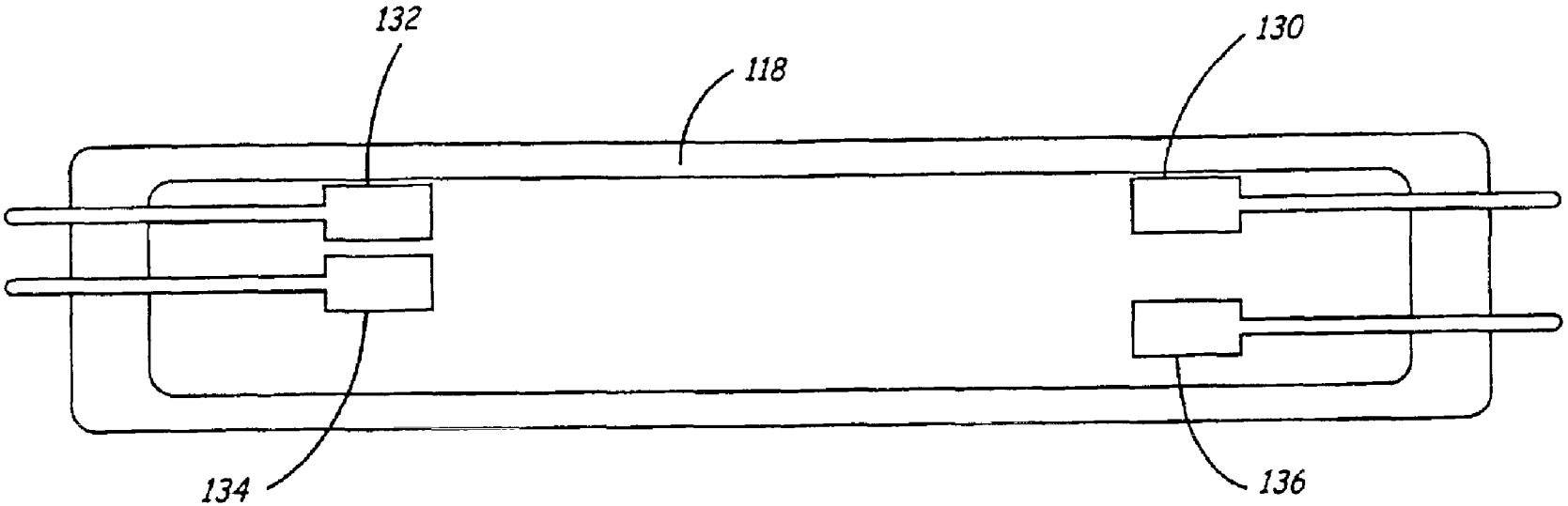
FIG. 4 is a bottom view of an example configuration of the antenna module of FIG. 2.

In the configuration shown in FIG. 4, the antenna 104 is implemented as an FM antenna to be connected to an FM radio system. The antenna module 102 receives FM signals from the antenna 104 via an antenna grid input terminal 130. Output signals are provided to the FM radio system via a coaxial cable having an antenna output terminal 132. The coaxial cable also has a coaxial shield terminal 134 to provide RF shielding. The antenna module 102 is grounded by an antenna module ground terminal 136. Power is supplied to the antenna module 102 via the coaxial cable.

Figure 5:
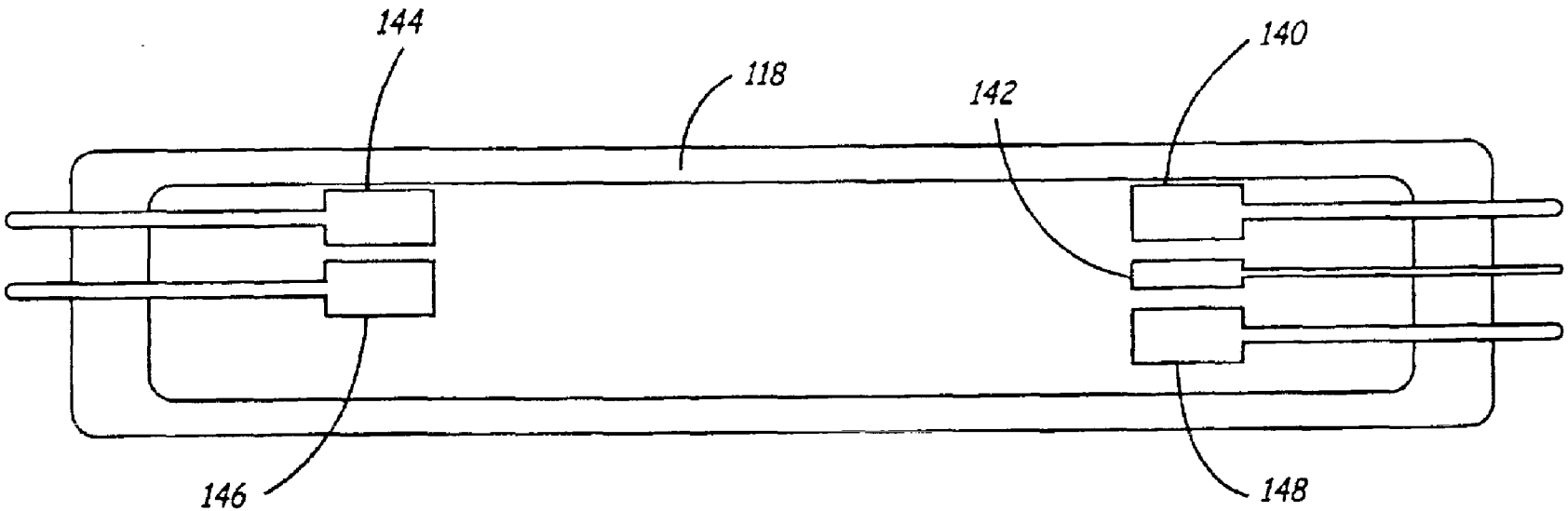
FIG. 5 is a bottom view of another example configuration of the antenna module of FIG. 2.

FIG. 5 illustrates an example configuration of an antenna module 102 coupled to an AM/FM radio system. The antenna module 102 receives AM signals from an AM antenna via an AM antenna input terminal 140. In addition, the antenna module 102 receives FM signals from an FM antenna via an FM antenna input terminal 142. Output signals are provided to the AM/FM radio system via a coaxial cable having an antenna output terminal 144. The coaxial cable also has a coaxial shield terminal 146 to provide RF shielding. The antenna module 102 is grounded by an antenna module ground terminal 148. Power is supplied to the antenna module 102 via the coaxial cable.

Figure 6:
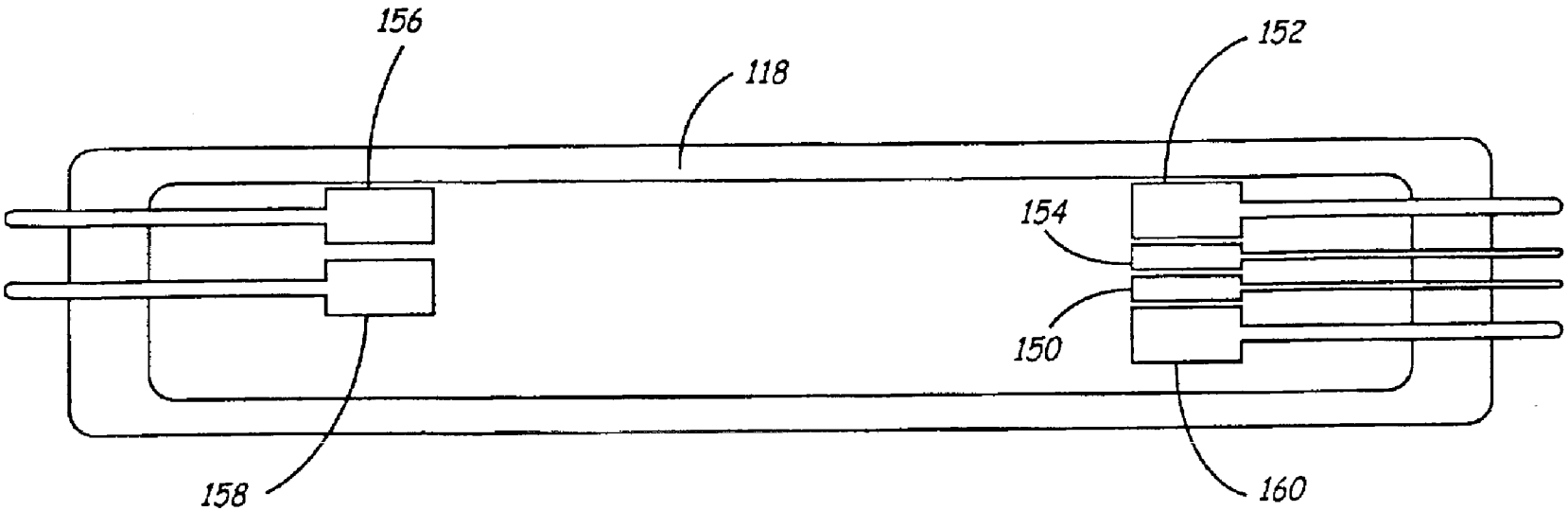
FIG. 6 is a bottom view of still another example configuration of the antenna module of FIG. 2.

FIG. 6 illustrates an example configuration of an antenna module 102 coupled to an AM/FM radio system. In this configuration, power is not supplied to the antenna module 102 via a coaxial cable. Rather, the antenna module 102 receives power via an antenna module power terminal 150. The antenna module 102 receives AM signals from an AM antenna via an AM antenna input terminal 152. In addition, the antenna module 102 receives FM signals from an FM antenna via an FM antenna input terminal 154. Output signals are provided to the AM/FM radio system via a coaxial cable having an antenna output terminal 156. The coaxial cable also has a coaxial shield terminal 158 to provide RF shielding. The antenna module 102 is grounded by an antenna module ground terminal 160.

In the configuration shown in FIG. 7, the antenna 104 is implemented as an FM antenna to be connected to an FM radio system. Unlike the configuration of FIG. 4, however, the cover 118 is formed from a conductive material. In this embodiment, the cover 118 is preferably mounted on the window glass 108 using a conductive adhesive. As a result, the cover 118 may serve as a Faraday cage around the antenna circuit board 110 to reduce interference. In addition, the cover 118 may provide a ground for the antenna module 102, in which case an antenna module ground terminal would not be needed. The antenna module 102 receives FM signals from the antenna 104 via an antenna grid input terminal 170. Output signals are provided to the FM radio system via a coaxial cable having an antenna output terminal 172. The coaxial cable also has a coaxial shield terminal 174 to provide RF shielding. Power is supplied to the antenna module 102 via the coaxial cable. Because the cover 118 is electrically conductive, it is important that the cover 118 not make contact with the conductors associated with the terminals 170, 172, and 174. Accordingly, the cover 118 defines a number of slots to electrically isolate the terminals 170, 172, and 174 from the cover 118.

Figure 8:
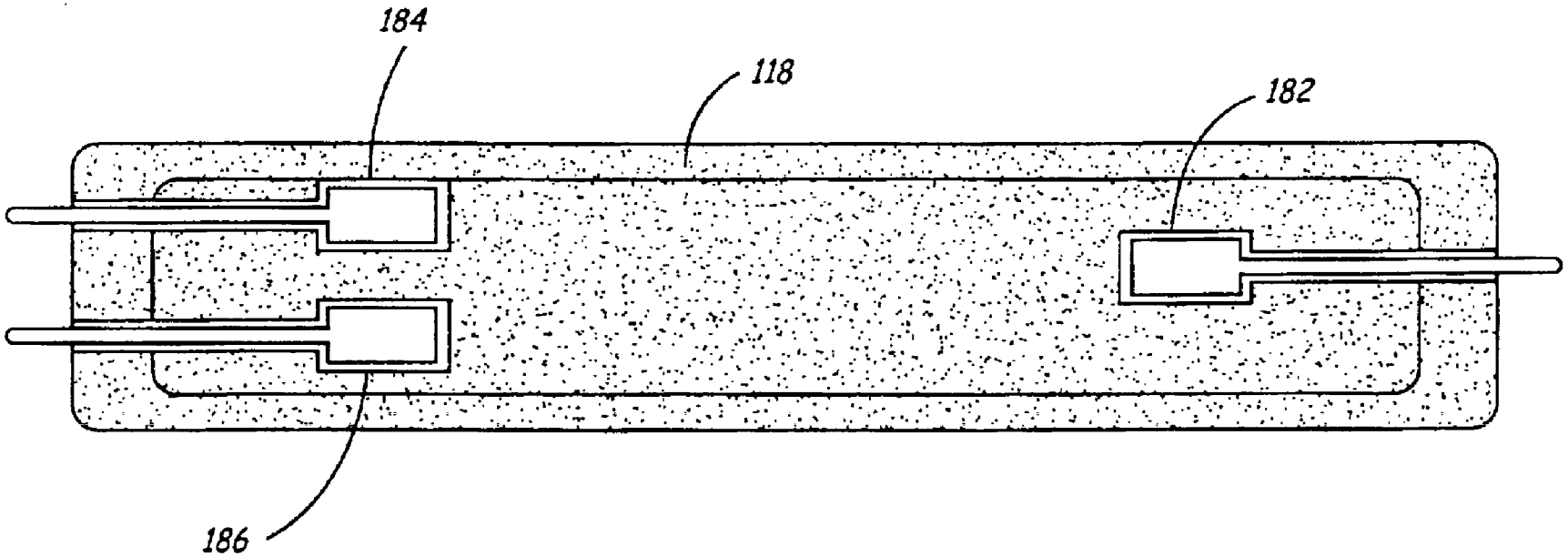
FIG. 8 is a bottom view of another example configuration of the antenna module of FIG. 2.

FIG. 8 illustrates a configuration, in some respects similar to the configuration depicted in FIG. 7, in which the cover 118 and an antenna module base 180 are both formed of a conductive material. In this embodiment, the cover 118 and the antenna module base 180 are preferably mounted on the window glass 108 using a conductive adhesive. As a result, the cover 118 and the antenna module base 180 may serve as a Faraday cage around the antenna circuit board 110 to reduce interference. Moreover, the cover 118 and the antenna module base 180 may collectively provide a ground for the antenna module 102, in which case an antenna module ground terminal would not be needed. The antenna module 102 receives FM signals from the antenna 104 via an antenna grid input terminal 182. Output signals are provided to the FM radio system via a coaxial cable having an antenna output terminal 184. The coaxial cable also has a coaxial shield terminal 186 to provide RF shielding. Power is supplied to the antenna module 102 via the coaxial cable. Because the cover 118 and the antenna module base 180 are electrically conductive, it is important that the cover 118 and the antenna module base 180 not make contact with the conductors associated with the terminals 182, 184, and 186. Accordingly, the cover 118 defines a number of slots to electrically isolate the terminals 182, 184, and 186 from the cover 118. Similarly, the antenna module base 180 is formed to define a number of apertures to electrically isolate the terminals 182, 184, and 186 from the antenna module base 180.

Alternatively, the antenna module base 180 may be replaced with a conductive pattern formed on the window glass 108. In this implementation, the conductive pattern, rather than the antenna module base 180, completes the Faraday cage around the antenna circuit board 110 and provides a ground for the antenna module 102. This implementation eliminates the need for the antenna module base 180 and its associated costs.

As demonstrated by the foregoing discussion, various embodiments of the present invention may facilitate improvements in the manufacturing process. For example, the antenna module can be installed independently of other manufacturing processes because neither plug-in connectors nor soldering is required. Installing the antenna module instead consists of adhesively mounting the antenna module cover to the glass or other surface on which the antenna module is to be installed. Thus, a single operation can both mount the antenna module on the glass and establish the required electrical connections. Consequently, installation costs may be reduced. Moreover, with the plug-in connector eliminated, the electrical connection to the antenna module can be made more reliable, thereby improving the initial quality of the antenna module.

It will be understood by those who practice the invention and those skilled in the art that various modifications and improvements may be made to the invention without departing from the spirit and scope of the disclosed embodiments. The scope of protection afforded is to be determined solely by the claims and by the breadth of interpretation allowed by law.

What is claimed is:

1. A vehicle communication system, comprising:

an antenna having an antenna terminal disposed on a surface of the vehicle;

a communication subsystem having a communication subsystem terminal disposed on the surface, wherein the communication subsystem terminal comprises one of an antenna module output terminal, a coaxial shield terminal, an antenna module power terminal, and an antenna module ground terminal; and an antenna module comprising:

antenna circuitry having a first circuit terminal and a second circuit terminal;

a first compressible contact electrically coupling the antenna terminal to the first circuit terminal when the compressible contact is compressed;

a second compressible contact electrically coupling the communication subsystem terminal to the second circuit terminal when the compressible contact is compressed; and a cover adhesively mounted to the surface, said cover being disposed over the antenna circuitry and arranged to compress the first and second compressible contacts when the cover is adhesively mounted to the surface.

2. The vehicle, communication system of claim 1, wherein the cover is formed from an electrically nonconductive material.

3. The vehicle communication system of claim 1, wherein the cover is formed from an electrically conductive material and defines a slot arranged to receive a conductor coupled to one of the antenna terminal and the communication subsystem terminal without establishing contact between the cover and the conductor.

4. The vehicle communication system of claim 3, wherein the cover is adhesively mounted to the surface using a conductive adhesive.

5. The vehicle communication system of claim 1, wherein the compressible contact is formed from silicone impregnated with a conductive material.

6. The vehicle communication system of claim 1, wherein the surface comprises a window glass.

7. The vehicle communication system of claim 1, further comprising an antenna module base arranged to snap together with the cover.

8. The vehicle communication system of claim 1, wherein the communication subsystem comprises at least one of a car radio, a wireless telephony system, a GPS system, a keyless entry system, a television system, and a remote tire pressure monitoring system.

9. A method for installing an antenna module, the method comprising:

providing antenna circuitry having a first terminal and a second terminal;

arranging a first compressible contact to electrically couple the first terminal to an antenna terminal disposed on a surface when the compressible contact is compressed;

arranging a second compressible contact to electrically couple the second terminal to a communication subsystem terminal of a communication subsystem disposed on the surface when the compressible contact is compressed, wherein the communication subsystem terminal comprises one of an antenna module output terminal, a coaxial shield terminal, an antenna module power terminal, and an antenna module ground terminal; and adhesively mounting a cover disposed over the antenna circuitry to the surface, thereby compressing the compressible contacts and electrically coupling the first terminal to the antenna terminal and the second terminal to the communication subsystem terminal.

10. The method of claim 9, wherein the cover is formed from an electrically nonconductive material.

11. The method of claim 9, wherein the cover is formed from an electrically conductive material and defines a slot arranged to receive a conductor coupled to the second terminal without establishing contact between the cover and the conductor.

12. The method of claim 11, further comprising adhesively mounting the cover to the surface using a conductive adhesive.

13. The method of claim 9, wherein the compressible contact is formed from silicone impregnated with a conductive material.

14. The method of claim 9, wherein the surface comprises a window glass.

15. The method of claim 14, wherein the window glass forms part of a vehicle.

16. The method of claim 9, further comprising attaching the cover to an antenna module base.

* * * * *